US007670547B2

(12) United States Patent
Kobayashi et al.

(10) Patent No.: US 7,670,547 B2
(45) Date of Patent: Mar. 2, 2010

(54) LOW ALLOY STEEL FOR OIL COUNTRY TUBULAR GOODS HAVING HIGH SULFIDE STRESS CRACKING RESISTANCE

(75) Inventors: Kenji Kobayashi, Osaka (JP); Tomohiko Omura, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/007,165

(22) Filed: Jan. 7, 2008

(65) Prior Publication Data

US 2008/0105337 A1 May 8, 2008

Related U.S. Application Data

(63) Continuation of application No. PCT/JP2006/313590, filed on Jul. 7, 2006.

(30) Foreign Application Priority Data

Jul. 8, 2005 (JP) ..... 2005-200682

(51) Int. Cl.
*C22C 38/00* (2006.01)
*C22C 38/60* (2006.01)
*C22C 38/22* (2006.01)

(52) U.S. Cl. ..... 420/121; 420/84; 420/105; 420/106; 148/330

(58) Field of Classification Search ..... 148/330; 420/84, 105, 106, 121
See application file for complete search history.

(56) References Cited

U.S. PATENT DOCUMENTS

| | | | | |
|---|---|---|---|---|
| 5,938,865 | A * | 8/1999 | Kondo et al. | 148/593 |
| 2002/0104592 | A1 | 8/2002 | Sakamoto et al. | |

FOREIGN PATENT DOCUMENTS

| | | |
|---|---|---|
| EP | 1 197 571 | 4/2002 |
| JP | 61-272351 | 12/1986 |
| JP | 62-040345 | 2/1987 |
| JP | 8-311551 | 11/1996 |
| JP | 11-335731 | 12/1999 |
| JP | 2000-313919 | 11/2000 |
| JP | 2001-271134 | 10/2001 |
| JP | 2004-332059 | 11/2004 |
| RU | 730868 | 4/1980 |
| RU | 2 243 284 | 12/2004 |
| RU | 2 255 123 | 6/2005 |
| WO | 00/68450 | 11/2000 |

* cited by examiner

*Primary Examiner*—Roy King
*Assistant Examiner*—Caitlin Fogarty
(74) *Attorney, Agent, or Firm*—Clark & Brody

(57) ABSTRACT

Low alloy steel for oil country tubular goods contains, in percentage by mass, 0.20% to 0.35% C, 0.05% to 0.5% Si, 0.05% to 0.6% Mn, at most 0.025% P, at most 0.01% S, 0.005% to 0.100% Al, 0.8% to 3.0% Mo, 0.05% to 0.25% V, 0.0001% to 0.005% B, at most 0.01% N, and at most 0.01% O, the balance comprising Fe and impurities, the steel satisfying Expression (1): $12V+1-Mo \geqq 0$ (1) where the symbols of elements represent the contents of the elements in percentage by mass. In this way, the steel according to the present invention has high SSC resistance.

16 Claims, 1 Drawing Sheet

LOW ALLOY STEEL FOR OIL COUNTRY TUBULAR GOODS HAVING HIGH SULFIDE STRESS CRACKING RESISTANCE

This application is a continuation of International Patent Application No. PCT/JP2006/313590, filed Jul. 7, 2006. This PCT application was not in English as published under PCT Article 21(2).

TECHNICAL FIELD

The present invention relates to low alloy steel for oil country tubular goods, and more specifically, to low alloy steel for oil country tubular goods for use in an oil well or a gas well.

BACKGROUND ART

Oil country tubular goods are used for extracting and producing crude oil or natural gas. An oil country tubular good has its both end threaded and further oil country tubular goods are added as the oil well or gas well is drilled to a deeper level. At the time, the oil country tubular good is subjected to stress by its own weight. Therefore, the oil country tubular good must have high strength. Deeper oil wells or gas wells have been drilled, and 110 ksi grade oil country tubular goods (having a yield strength from 758 MPa to 861 MPa) have been used recently and development of 125 ksi grade oil country tubular goods (having a yield strength of 861 MPa to 965 MPa) is under way.

Such oil country tubular goods for use in oil wells or gas wells must have high resistance against sulfide stress cracking (hereinafter referred to as "SSC"). The SSC is generated because of stress acting on steel used in a hydrogen sulfide environment and the SSC resistance generally decreases as the strength of the steel increases. Therefore, improvement of the SSC resistance is crucial for oil country tubular goods having high strength.

Reported methods for improving the SSC resistance of a high strength oil oil country tubular good include the following approaches.

(1) To highly clean the steel.

(2) To quench the steel and then temper the steel at high temperatures.

(3) To refine the crystal grains of the steel. The steel is for example quenched twice or subjected to induction heating, so that the crystal grains are refined.

(4) To control the morphology of carbide generated in the steel. More specifically, to refine or/and spheroidize the carbide.

In the disclosure of JP 2000-313919 A or International Publication 00/68450 pamphlet, steel is made to have a homogeneous martensite structure by reducing its Cr content and carrying out direct quenching, so that the SSC resistance of the steel for high-strength oil country tubular goods can be improved.

As described above, improvement of steel has been focused on improvement of the internal quality of the steel. However, high strength oil country tubular goods provided with the above-described countermeasures sometimes still suffer from SSC.

DISCLOSURE OF THE INVENTION

It is an object of the present invention to provide low alloy steel for oil country tubular goods having high SSC resistance.

The inventors have considered about approaches for improving SSC resistance different from the conventional internal quality improvement, and concluded that the SSC resistance could be more improved by restraining hydrogen from being introduced into the steel. To this end, they examined which alloy elements affect the hydrogen introduction for the purpose of restraining penetrating hydrogen.

A plurality of test specimens having various kinds of yield strength were produced from steel with steel numbers having chemical compositions given in Table 1.

TABLE 1

| steel | chemical composition (unit: % by mass, the balance comprising Fe and impurities) | | | | | | | | | | | | | |
|---|---|---|---|---|---|---|---|---|---|---|---|---|---|---|
| No. | C | Si | Mn | P | S | Cr | Mo | V | Al | N | B | O | Ti | Nb |
| 1 | 0.27 | 0.19 | 0.44 | 0.010 | 0.001 | 0.20 | 0.70 | 0.19 | 0.032 | 0.004 | 0.0011 | 0.004 | — | — |
| 2 | 0.28 | 0.19 | 0.44 | 0.010 | 0.001 | 0.20 | 1.02 | 0.19 | 0.033 | 0.004 | 0.0011 | 0.003 | 0.015 | — |
| 3 | 0.30 | 0.19 | 0.44 | 0.010 | 0.001 | 0.00 | 0.99 | 0.19 | 0.033 | 0.004 | 0.0013 | 0.003 | 0.015 | 0.022 |

Each test specimens were subjected to a DCB (Double Cantilever Beam) test based on the following conditions, and the stress intensity factor $K_{ISSC}$ of each kind of steel was obtained. FIGS. 1 and 2 show the relation between the yield strength and the stress intensity factor $K_{ISSC}$ of each kind of steel obtained by the DCB test.

The inventors have found based on the result of the above-described DCB tests and various other kinds of examination that carrying out (A) to (D) as follows is effective in improving the SSC resistance by preventing hydrogen from being penetrating.

(A) Among the alloy elements, steel typically contains Mn and Cr so that the quenching characteristic is improved. However, Mn degrades the SSC resistance. Furthermore, as shown in FIG. 1, in high-strength steel of 110 ksi grade or more, Cr also degrades the SSC resistance. As described above, Mn and Cr lower the SSC resistance in this way because Mn and Cr accelerate corrosion as they actively dissolve in a hydrogen sulfide environment, which assists hydrogen to penetrate into the steel.

Therefore, in order to improve the SSC resistance, the contents of Mn and Cr must be limited to about exact amounts required for securing a necessary quenching characteristic. More specifically, only Mn is contained in principle while Cr is contained as required.

(B) Among the alloy elements, Mo restrains hydrogen from penetrating. More specifically, Mo accelerates formation of a dense iron sulfide layer on the surface of steel, and the iron sulfide layer thus formed restrains corrosion and hydrogen penetration. Furthermore, the iron sulfide layer increases the hydrogen overvoltage of the steel, and hydrogen is also restrained from penetrating by the increase in the hydrogen overvoltage. Therefore, the Mo content is increased in order to improve the SSC resistance.

(C) If the Mo content is increased, the hydrogen penetration can effectively be restrained, while if the content exceeds 1%, needle-shaped $Mo_2C$ is generated in the steel, so that SSC is more likely to be generated from the $Mo_2C$ as the origin. Therefore, in order to increase the Mo content, $Mo_2C$ must be restrained from being generated.

In order to reduce the generation of $Mo_2C$, addition of V is effective because V combines with Mo and C to generate fine carbide MC (M is either V or Mo), which prevents Mo from forming $Mo_2C$.

The inventors carried out DCB tests as described above using a plurality of kinds of steel having different Mo and V contents to examine their SSC resistance. It has been found as the result that if the following Expression (1) is satisfied, the generation of $Mo_2C$ can be restrained and the SSC resistance can be prevented from being lowered.

$$12V+1-Mo \geqq 0 \quad (1)$$

where the symbols of elements represent the contents of the elements (% by mass).

Therefore, in order to improve the SSC resistance, the Mo content is increased and the V content is adapted to satisfy Expression (1).

(D) If Cr is contained, penetration of hydrogen can be accelerated coursed by the contained Mn and Cr. However, as shown in FIG. 2, if the Mo content is increased, the decrease in the SSC resistance caused by the contained Mn and Cr can be restrained and the SSC resistance can further be improved. Therefore, the Mo content must be about as high as to prevent the SSC resistance from being lowered because of the contained Mn and Cr.

The inventors conducted DCB tests as described above using a plurality of kinds of steel having different Mn, Cr, and Mo contents and examined for their SSC resistance. It has been found as the result that if the Mo content satisfies the following Expression (2), the decrease of the SSC resistance caused by the contained Cr and Mn can be reduced.

$$Mo-(Cr+Mn) \geqq 0 \quad (2)$$

where the symbols of elements represent the contents of the elements (% by mass).

Therefore, if Cr is contained, the Mo content must satisfy Expression (2) in order to improve the SSC resistance.

Based on the above-described findings, the inventors completed the following invention.

Low alloy steel for oil country tubular goods according to the invention contains, in percentage by mass, 0.20% to 0.35% C, 0.05% to 0.5% Si, 0.05% to 0.6% Mn, at most 0.025% P, at most 0.01% S, 0.005% to 0.100% Al, 0.8% to 3.0% Mo, 0.05% to 0.25% V, 0.0001% to 0.005% B, at most 0.01% N, and at most 0.01% O, the balance includes Fe and impurities, and the steel satisfies Expression (1):

$$12V+1-Mo \geqq 0 \quad (1)$$

where the symbols of elements represent the contents of the elements (% by mass).

The low alloy steel for oil country tubular goods preferably further includes at most 0.6% Cr and satisfies Expression (2):

$$Mo-(Cr+Mn) \geqq 0 \quad (2)$$

where the symbols of elements represent the contents of the elements (% by mass).

The low alloy steel for oil country tubular goods preferably further includes at least one of at most 0.1% Nb, at most 0.1% Ti and at most 0.1% Zr.

The low alloy steel for oil country tubular goods preferably further includes at most 0.01% Ca.

The low alloy steel for oil country tubular goods preferably has a yield strength of at least 861 MPa that corresponds to 125 ksi.

BEST MODE FOR CARRYING OUT THE INVENTION

Figure 1:
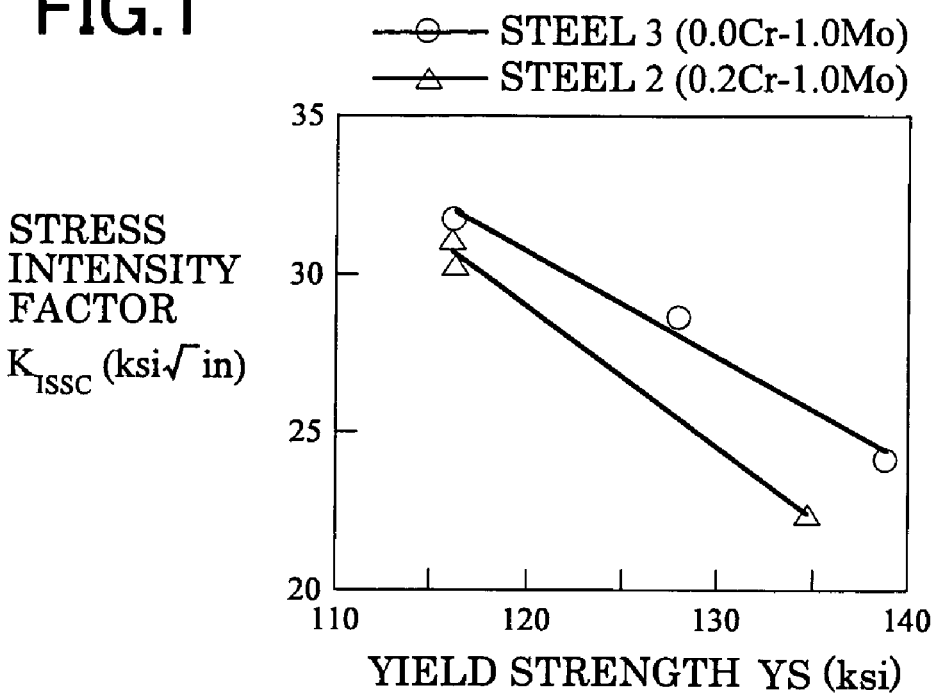
FIG. 1 is a graph showing the effect of Cr on a stress intensity factor obtained by a DCB test.

Now, an embodiment of the present invention will be described in detail.

1. Chemical Composition

Low alloy steel for oil country tubular goods according to an embodiment of the invention has the following composition. Hereinafter, "%" related to the elements means "% by mass."

C, 0.20% to 0.35%

Carbon improves the hardenability and the strength of steel. However, an excessive C content causes excessive carbides to be generated, which lowers the SSC resistance. Therefore, the C content is in the range from 0.20% to 0.35%, preferably from 0.25% to 0.30%.

Si: 0.05% to 0.5%

Silicon is effective in deoxidizing steel and improves the resistance to temper softening. However, an excessive Si content accelerates the precipitation of a ferrite phase which is a softening phase. The ferrite phase degrades the SCC resistance. Therefore, the Si content is from 0.05% to 0.5%, preferably from 0.05% to 0.35%.

Mn: 0.05% to 0.6%

Manganese is an important element according to the invention. Manganese improves the quenching characteristic and contributes to improvement of the strength. However, Mn actively dissolves in hydrogen sulfide and accelerates the corrosion to assist hydrogen to penetrate. Therefore, according to the invention, the Mn content is preferably limited to the minimum necessary amount that allows necessary strength to be secured. Therefore, the Mn content is from 0.05% to 0.6%, preferably from 0.3% to 0.5%.

P: 0.025% or less

Phosphorus is an impurity that is segregated at grain boundaries and lowers the SSC resistance. Therefore, the P content is preferably as low as possible. The P content is 0.025% or less.

S: 0.01% or less

Sulfur is an impurity that is segregated at grain boundaries similarly to P and lowers the SSC resistance. Therefore, the S content is preferably as low as possible. The S content is 0.01% or less.

Al: 0.005% to 0.100%

Aluminum is effective in deoxidizing steel. However, the effect reaches saturation if Al is excessively contained. Therefore, the Al content is from 0.005% to 0.100%, preferably from 0.01% to 0.05%. Note that the Al content according to the embodiment is that of acid-soluble aluminum (sol. Al).

Mo: 0.8% to 3.0%

Molybdenum is an important element according to the invention that improves the quenching characteristic. Molybdenum also accelerates the generation of a dense iron sulfide layer on the surface of the steel. The generation of the iron sulfide layer restrains corrosion and raises hydrogen overvoltage, which restrains hydrogen penetration. However, an excessive Mo content causes the effect to reach saturation and is also undesirable in view of the manufacturing cost. Therefore, the Mo content is in the range from 0.8% to 3.0%, preferably from 1.0% to 2.5%.

V: 0.05% to 0.25%

Vanadium is an important element according to the invention that improves the quenching characteristic. Vanadium further combines with C as well as Mo to generate fine carbide MC (M is V and Mo). The generation of the fine carbide MC restrains the generation of needle shaped $Mo_2C$ which can be an origin for SSC. Furthermore, V raises the tempering temperature to allow cementite at grain boundaries to be spheroidized, which restrains the generation of SSC. Therefore, according to the invention, V contributes to improvement of the SSC resistance. An excessive V content however causes coarse VC to be precipitated. Such coarse VC stores hydrogen, which lowers the SSC resistance. Note that the fine VC contributes to precipitation hardening but the coarse VC does not. Therefore, the V content is from 0.05% to 0.25%, preferably from 0.05% to 0.20%.

B: 0.0001% to 0.005%

Boron improves the quenching characteristic. However, in high strength steel according to the invention, B accelerates the generation of coarse carbide $M_{23}C_6$ (M is Fe, Cr or Mo) that can be an origin for SSC and therefore an excessive content thereof is not preferable. The B content is from 0.0001% to 0.005%, preferably from 0.0005% to 0.002%.

N: 0.01% or less

Nitrogen is an impurity that forms coarse nitride and lowers the toughness and the SSC resistance. Therefore, the N content is preferably as low as possible. According to the invention, the N content is 0.01% or less.

O: 0.01% or less

Oxygen is an impurity that forms coarse oxide and lowers the toughness and the SSC resistance. Therefore, the O content is preferably as low as possible. According to the invention, the O content is 0.01% or less.

The balance includes Fe but it may contain impurities other than P, S, N, and O for various causes during the manufacturing process.

The low alloy steel for oil country tubular goods according to the invention further satisfies the following Expression (1):

$$12V+1-Mo \geqq 0 \quad (1)$$

where the symbols of elements represent the contents of the elements (% by mass).

As the Mo content increases, the Mo in the steel combines with C to form $Mo_2C$. Such $Mo_2C$ is excessively generated particularly when the Mo content exceeds 1%. Since $Mo_2C$ has a needle shape and therefore SSC is likely to be generated from $Mo_2C$ as an origin. Therefore, if the Mo content is increased to reduce hydrogen penetration, the generation of $Mo_2C$ must be restrained.

Vanadium combines with Mo and C to form fine (V, Mo) C and prevents Mo from forming $Mo_2C$. If the V content satisfies Expression (1), the generation of $Mo_2C$ can be restrained.

The low alloy steel for oil country tubular goods according to the invention further contains Cr if necessary. In other words, Cr is an optional element.

Cr: 0.6% or less.

Chromium improves the quenching characteristic but accelerates hydrogen to penetrate similarly to Mn. An excessive Cr content therefore lowers the SSC resistance. Therefore, the Cr content is 0.6% or less, the preferable upper limit for the Cr content is 0.3% and the preferable lower limit for the Cr content is 0.1%.

If the low alloy steel for oil country tubular goods according to the invention contains Cr, the steel further satisfies the following Expression (2):

$$Mo-(Cr+Mn) \geqq 0 \quad (2)$$

where the symbols of elements represent the contents of the elements (% by mass).

As described above, Mn and Cr accelerate hydrogen to penetrate, and if the Mo content is increased to generate an iron sulfide layer, hydrogen can be restrained from penetrates despite the contained Mn and Cr. More specifically, if the Mo content satisfies Expression (2), the SSC resistance can be prevented from being lowered because of the Mn and Cr.

The low alloy steel for oil country tubular goods according to the invention contains at least one of Nb, T, and Zr if necessary. More specifically, these elements are optional elements. These elements contribute to improvement of mechanical properties such as toughness.

Nb: 0.1% or less

Ti: 0.1% or less

Zr: 0.1% or less

More specifically, Nb, Ti, and Zr combine with C and N to form carbonitride. The carbonitride causes a pinning effect, which refines the crystal grains and improves mechanical properties such as toughness. However, if these elements are excessively contained, the effect reaches saturation. Therefore, the Nb, Ti, and Zr contents are each 0.1% or less. Preferably, the Nb content is from 0.002% to 0.1%, the Ti content is from 0.002% to 0.1%, and the Zr content is from 0.002% to 0.1%. More preferably, the Nb content is from 0.01% to 0.05%, the Ti content is from 0.01% to 0.05%, and the Zr content is from 0.01% to 0.05%.

The low alloy steel for oil country tubular goods according to the invention further contains Ca if necessary. More specifically, Ca is an optional element.

Ca: 0.01% or less

Calcium spheroidizes MnS that can form an origin for SSC, which lowers the SSC sensitivity. Note that if the low alloy steel for oil country tubular goods is produced by continuous casting, Ca restrains the generation of coarse $Al_2O_3$, so that a submerged nozzle in a continuous casting device can be prevented from being clogged. Therefore, the Ca content is 0.01% or less, preferably from 0.0003% to 0.01%, more preferably from 0.0005% to 0.003%.

2. Strength

The low alloy steel for oil country tubular goods according to the present invention has a yield strength of at least 110 ksi (758 MPa), preferably at least 125 ksi (861 MPa). In short, the low alloy steel for oil country tubular goods has at least 110 ksi grade strength, preferably 125 ksi grade strength (i.e., the yield strength is from 125 ksi to 140 ksi or from 861 MPa to 965 MPa). The strength of the steel according to the present invention can have high SSC resistance based on the above-described chemical composition despite its high strength.

3. Manufacturing Method

The steel having the above described chemical composition is melted and refined according to a well known method. Then, the molten steel is made into a continuous cast material by continuous casting. The continuous cast material is for example, slabs, blooms, or billets. Alternatively, the molten steel is cast into ingots by an ingot making method.

The slab, bloom, or ingot is made into billets by hot working. At the time, the billets may be formed by hot rolling or hot forging.

The billets obtained by continuous casting or hot working are subjected to hot working and formed into the low alloy steel for oil country tubular goods. For example, a Mannesmann method can be conducted as the hot working to form oil country tubular goods. The low alloy steel for oil country tubular goods may be formed by other hot working methods. The steel after the hot working is cooled to ambient temperatures.

After the cooling, quenching and tempering is carried out. If the quenching temperature is in the range from 900° C. to 950° C., and the tempering temperature can be adjusted as required in response to the chemical composition of the steel, the yield strength of the low alloy steel for oil country tubular goods can be adjusted to be in the range described in 2.

FIRST EMBODIMENT

Pieces of low alloy steel for oil country tubular goods having various chemical compositions were produced and evaluated for their SSC resistance by conducting DCB tests.

Examination Method

Steel pieces having chemical compositions in Table 2 were melted in vacuum and a 50 g ingot was produced for each.

TABLE 2

| | | chemical composition (unit: % by mass, the balance comprising Fe and impurities) | | | | | | | | | | | | | | | |
|---|---|---|---|---|---|---|---|---|---|---|---|---|---|---|---|---|---|
| Test No. | | C | Si | Mn | P | S | Mo | V | Al | N | B | O | Cr | Ti | Nb | Zr | Ca |
| Inv. Ex. | 1 | 0.26 | 0.22 | 0.40 | 0.007 | 0.002 | 0.82 | 0.12 | 0.030 | 0.004 | 0.0010 | 0.003 | — | — | — | — | — |
| | 2 | 0.29 | 0.41 | 0.36 | 0.006 | 0.002 | 1.49 | 0.15 | 0.031 | 0.003 | 0.0012 | 0.004 | — | — | — | — | — |
| | 3 | 0.27 | 0.21 | 0.42 | 0.005 | 0.001 | 1.99 | 0.15 | 0.032 | 0.004 | 0.0012 | 0.003 | — | — | — | — | — |
| | 4 | 0.26 | 0.22 | 0.44 | 0.006 | 0.002 | 2.97 | 0.17 | 0.030 | 0.004 | 0.0009 | 0.003 | — | — | — | — | — |
| | 5 | 0.26 | 0.23 | 0.43 | 0.009 | 0.001 | 1.51 | 0.19 | 0.033 | 0.006 | 0.0010 | 0.004 | — | — | — | — | — |
| | 6 | 0.28 | 0.24 | 0.44 | 0.004 | 0.001 | 1.21 | 0.05 | 0.033 | 0.003 | 0.0013 | 0.005 | — | — | — | — | — |
| | 7 | 0.23 | 0.25 | 0.30 | 0.008 | 0.001 | 1.22 | 0.11 | 0.030 | 0.005 | 0.0011 | 0.004 | 0.30 | — | — | — | — |
| | 8 | 0.28 | 0.19 | 0.44 | 0.010 | 0.001 | 1.02 | 0.19 | 0.033 | 0.004 | 0.0011 | 0.003 | 0.20 | 0.015 | — | — | — |
| | 9 | 0.32 | 0.22 | 0.41 | 0.009 | 0.001 | 1.20 | 0.06 | 0.033 | 0.006 | 0.0011 | 0.005 | 0.30 | — | — | — | 0.002 |
| | 10 | 0.30 | 0.19 | 0.44 | 0.010 | 0.001 | 0.99 | 0.19 | 0.033 | 0.004 | 0.0013 | 0.003 | — | 0.015 | 0.022 | — | — |
| | 11 | 0.28 | 0.33 | 0.44 | 0.007 | 0.002 | 2.03 | 0.10 | 0.031 | 0.005 | 0.0014 | 0.003 | — | — | 0.031 | — | — |
| | 12 | 0.24 | 0.20 | 0.52 | 0.004 | 0.002 | 1.98 | 0.16 | 0.030 | 0.004 | 0.0009 | 0.004 | — | — | — | 0.026 | — |
| Comp. Ex. | 13 | 0.40 | 0.23 | 0.45 | 0.003 | 0.001 | 1.20 | 0.11 | 0.031 | 0.004 | 0.0010 | 0.004 | — | — | — | — | — |
| | 14 | 0.27 | 0.71 | 0.44 | 0.004 | 0.002 | 0.98 | 0.11 | 0.033 | 0.006 | 0.0010 | 0.003 | — | — | — | — | — |
| | 15 | 0.28 | 0.20 | 1.00 | 0.002 | 0.001 | 1.20 | 0.12 | 0.032 | 0.006 | 0.0013 | 0.003 | — | — | 0.029 | — | — |
| | 16 | 0.26 | 0.15 | 0.45 | 0.039 | 0.001 | 0.99 | 0.11 | 0.033 | 0.007 | 0.0012 | 0.004 | — | — | — | — | — |
| | 17 | 0.28 | 0.22 | 0.44 | 0.006 | 0.013 | 0.98 | 0.09 | 0.033 | 0.004 | 0.0009 | 0.003 | — | — | — | — | — |
| | 18 | 0.27 | 0.20 | 0.40 | 0.007 | 0.002 | 0.70 | 0.10 | 0.003 | 0.003 | 0.0010 | 0.003 | — | — | — | — | — |
| | 19 | 0.27 | 0.19 | 0.44 | 0.010 | 0.001 | 0.70 | 0.19 | 0.032 | 0.004 | 0.0011 | 0.004 | 0.20 | — | — | — | — |
| | 20 | 0.25 | 0.20 | 0.38 | 0.006 | 0.001 | 0.80 | 0.02 | 0.030 | 0.005 | 0.0010 | 0.004 | 0.20 | 0.015 | — | — | — |
| | 21 | 0.26 | 0.22 | 0.35 | 0.003 | 0.001 | 0.99 | 0.30 | 0.034 | 0.005 | 0.0009 | 0.004 | — | 0.015 | — | — | — |
| | 22 | 0.24 | 0.21 | 0.51 | 0.003 | 0.001 | 0.80 | 0.11 | 0.032 | 0.021 | 0.0010 | 0.004 | 0.19 | — | — | — | — |
| | 23 | 0.26 | 0.19 | 0.43 | 0.005 | 0.002 | 1.20 | 0.11 | 0.033 | 0.003 | 0.0011 | 0.004 | 0.70 | — | — | — | — |
| | 24 | 0.26 | 0.22 | 0.42 | 0.004 | 0.001 | 2.01 | 0.06 | 0.033 | 0.006 | 0.0012 | 0.003 | — | — | — | — | — |
| | 25 | 0.28 | 0.31 | 0.44 | 0.007 | 0.002 | 2.00 | 0.07 | 0.032 | 0.004 | 0.0014 | 0.004 | — | — | 0.037 | — | — |
| | 26 | 0.26 | 0.22 | 0.51 | 0.006 | 0.001 | 0.90 | 0.11 | 0.030 | 0.006 | 0.0009 | 0.003 | 0.50 | — | — | — | — |
| | 27 | 0.24 | 0.17 | 0.50 | 0.004 | 0.002 | 0.91 | 0.12 | 0.033 | 0.007 | 0.0011 | 0.003 | 0.49 | — | 0.030 | — | — |

| | | | | experiment value | | | | | | |
|---|---|---|---|---|---|---|---|---|---|---|
| | | | | steel plate 1 | | steel plate 2 | | steel plate 3 | | app. value |
| Test No. | | F1 | F2 | YS ksi | $K_{ISSC}$ ksi $\sqrt{in.}$ | YS ksi | $K_{ISSC}$ ksi $\sqrt{in.}$ | YS ksi | $K_{ISSC}$ ksi $\sqrt{in.}$ | $K_{140}$ ksi $\sqrt{in.}$ |
| Inv. Ex. 1 | | 1.62 | — | 119.35 | 27.8 | 134.28 | 24.7 | | | 23.2 |
| 2 | | 1.31 | — | 118.33 | 29.4 | 136.48 | 25.2 | | | 24.2 |
| 3 | | 0.81 | — | 127.32 | 28.3 | 132.56 | 26.6 | | | 24.6 |
| 4 | | 0.07 | — | 124.56 | 29.4 | 137.18 | 25.6 | | | 24.8 |
| 5 | | 1.77 | — | 113.56 | 30.5 | 128.33 | 26.4 | 135.23 | 25.3 | 24.0 |
| 6 | | 0.39 | — | 118.82 | 29.3 | 121.25 | 27.8 | 134.55 | 25.7 | 24.2 |
| 7 | | 1.10 | 0.62 | 120.10 | 29.0 | 134.23 | 25.4 | | | 23.8 |
| 8 | | 2.26 | 0.38 | 116.12 | 31.1 | 116.27 | 30.3 | 134.77 | 24.9 | 23.5 |
| 9 | | 0.52 | 0.49 | 118.36 | 29.4 | 138.96 | 23.9 | | | 23.6 |
| 10 | | 2.29 | — | 116.27 | 31.7 | 128.02 | 28.6 | 138.91 | 24.1 | 23.8 |
| 11 | | 0.17 | — | 125.02 | 25.1 | 140.40 | 24.6 | | | 24.7 |
| 12 | | 0.94 | — | 123.25 | 28.3 | 137.33 | 25.3 | | | 24.6 |
| Comp. Ex. 13 | | 1.12 | — | 127.21 | 23.3 | 138.20 | 19.3 | | | 18.8 |
| 14 | | 1.34 | — | 124.76 | 23.6 | 134.55 | 20.1 | | | 18.6 |
| 15 | | 1.24 | — | 116.34 | 26.4 | 132.96 | 21.6 | | | 19.7 |
| 16 | | 1.33 | — | 115.68 | 31.0 | 128.10 | 22.6 | 136.01 | 18.3 | 17.2 |
| 17 | | 1.10 | — | 121.63 | 25.4 | 135.31 | 21.2 | | | 19.9 |
| 18 | | 1.50 | — | 114.22 | 28.8 | 129.60 | 24.6 | | | 21.8 |
| 19 | | 2.58 | 0.06 | 112.27 | 28.9 | 119.89 | 27.6 | 126.06 | 22.8 | 19.0 |
| 20 | | 0.44 | 0.22 | 110.97 | 31.4 | 120.40 | 28.2 | 129.11 | 20.9 | 18.0 |
| 21 | | 3.61 | — | 111.26 | 29.2 | 129.62 | 23.7 | | | 20.9 |

TABLE 2-continued

| | | | | | | | | | |
|---|---|---|---|---|---|---|---|---|---|
| 22 | 1.52 | 0.10 | 111.69 | 31.1 | 113.36 | 30.3 | 132.68 | 23.1 | 21.1 |
| 23 | 1.12 | 0.07 | 116.99 | 29.3 | 143.92 | 17.1 | | | 18.2 |
| 24 | −0.29 | — | 121.92 | 26.0 | 134.39 | 23.1 | | | 21.6 |
| 25 | −0.16 | — | 118.37 | 27.6 | 132.30 | 22.9 | | | 20.8 |
| 26 | 1.42 | −0.11 | 120.42 | 27.0 | 138.23 | 22.1 | | | 21.6 |
| 27 | 1.53 | −0.08 | 119.46 | 28.2 | 132.52 | 23.4 | | | 21.4 |

*F1 = 12 V + 1 − Mo
*F2 = Mo − (Cr + Mn)
*Underlined values are outside the range defined by the invention.

In Table 2, "F1" and "F2" are values obtained based on the following Expressions (3) and (4):

$$F1=12V+1-Mo \tag{3}$$

$$F2=Mo-(Cr+Mn) \tag{4}$$

In short, Expression (3) is the left term of Expression (1) and Expression (4) is the left term of Expression (2).

With reference to Table 2, steel with test Nos. 1 to 12 each had a chemical composition within the range defined by the present invention. Steel with test Nos. 1 to 6 and 10 to 12 had positive F1 values and satisfied Expression (1). Steel with test Nos. 7 to 9 containing Cr had positive values for both F1 and F2 values and satisfied Expressions (1) and (2).

Meanwhile, steel with test Nos. 13 to 23 each had a chemical composition partly outside the range defined by the present invention. Steel with test Nos. 24 and 25 each had a chemical composition within the range defined by the present invention but had a negative F1 value and did not satisfy Expression (1). Steel with test Nos. 26 and 27 containing Cr each had a chemical composition within the range defined by the present invention and satisfied Expression (1) but did not satisfy Expression (2) because their F2 values were negative.

The produced ingots were heated to 1250° C. and then formed into blocks having a thickness of 60 mm by hot forging. Then, each block was heated to 1250° C. and then formed into a steel plate as thick as 12 mm by hot rolling. A plurality of steel plates were produced for each test number shown in Table 2.

Then, the yield strength of each produced steel plate was adjusted to be in the range from 110 ksi to 140 ksi (758 MPa to 965 MPa). More specifically, each steel plate was held at 920° C. for 15 minutes and then subjected to water-quenching. After the quenching, tempering was conducted at various temperatures within the range from 670° C. to 720° C. During the tempering, each steel plate was held at each tempering temperature for 30 minutes and then cooled by air. In this way, a plurality of steel plates having different yield strength for each test number (steel plates 1 and 2 or 1 to 3 in the column "experiment value" in Table 2) were prepared.

Using each steel plate, a DCB test was conducted and the SSC resistance was evaluated. A DCB test specimen having a thickness of 10 mm, a width of 25 mm, and a length of 100 mm was taken from each steel plate. The sampled DCB test specimen was used to conduct DCB tests according to NACE (National Association of Corrosion Engineers) TM0177-96 Method D. A 5% salt+0.5% acetic acid aqueous solution at 24 degree C. having a 1 atm hydrogen sulfide gas saturated therein was used as a test bath. Each DCB test specimen was immersed in the test solution for 336 hours to conduct a DCB test. After the test, the length a of crack propagation generated in the DCB test specimen was measured. Based on the measured crack propagation length a and wedge opening stress P, a stress intensity factor $K_{ISSC}$ (ksi√in) was obtained according to Expression (5).

$$K_{ISSC} = \frac{Pa\left(2\sqrt{3} + 2.38\frac{h}{a}\right)\left(\frac{B}{B_n}\right)^{\frac{1}{\sqrt{3}}}}{Bh^{\frac{3}{2}}} \tag{5}$$

wherein h represents the height of each arm of a DCB test specimen, B represents the thickness of the DCB test specimen, and $B_n$ represents the web thickness of the DCB test specimen. These are defined by NACE TM0177-96 Method D.

Stress intensity factors $K_{ISSC}$ obtained for the steel plates are given in "experiment value" in Table 2.

Then, using each stress intensity factor $K_{ISSC}$ obtained in the DCB test, an approximate stress intensity factor $K_{140}$ (hereinafter referred to as "approximate value $K_{140}$") was obtained when the yield strength of each of the steel plates was 140 ksi by the following method.

The approximate value $K_{140}$ was obtained in order to compare the stress intensity factors $K_{ISSC}$ based on the same yield strength among the steel with the test numbers. The reference yield strength was 140 ksi in order to compare the stress intensity factors $K_{ISSC}$ for high strength. Now, a method of calculating the approximate value $K_{140}$ will be described.

Figure 2:
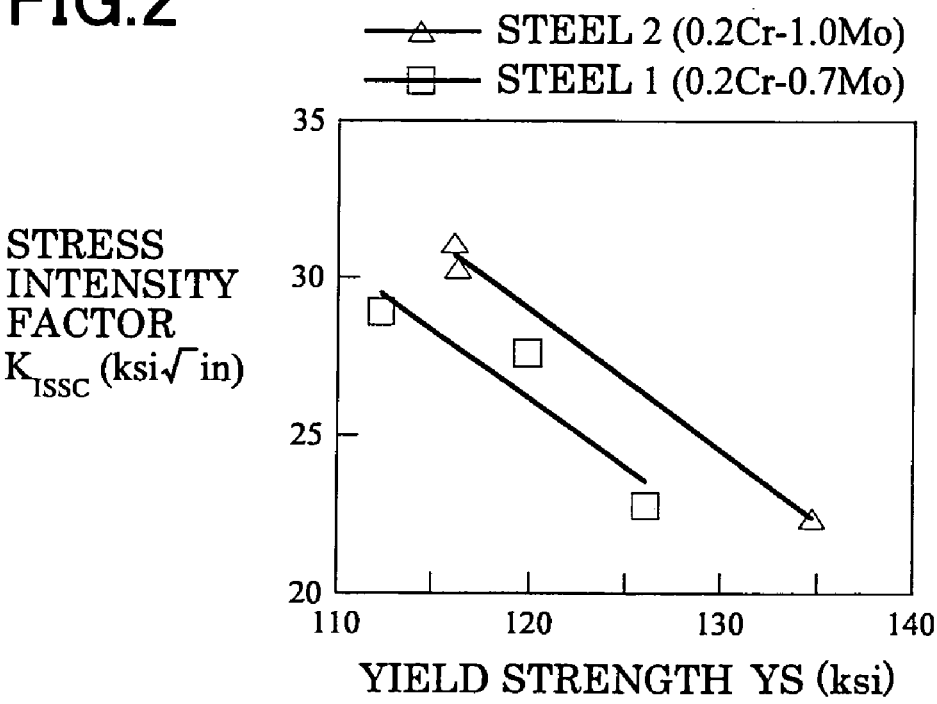
FIG. 2 is a graph showing the effect of Mo on a stress intensity factor obtained by a DCB test.

In general, the stress intensity factor $K_{ISSC}$ depends on the strength. For example, as shown in FIGS. 1 and 2, as the strength increases, the stress intensity factor $K_{ISSC}$ decreases. The inclination of the stress intensity factor $K_{ISSC}$ at the time is substantially constant independently of, the chemical composition. Therefore, using the yield strength YS and the stress intensity factors $K_{ISSC}$ of the steel plates used in the DCB tests, the inclination of the stress intensity factor $K_{ISSC}$ was obtained and an approximation formula as given by Expression (6) was derived.

$$\text{Approximate value } K_{140}=-0.27\times(140-YS)+K_{ISSC} \tag{6}$$

where YS represents the yield strength (ksi) of a steel plate and $K_{ISSC}$ represents a stress intensity factor $K_{ISSC}$ obtained by Expression (5).

Among the experiment values for the test numbers, by substituting the yield strength YS and the stress intensity factor $K_{ISSC}$ obtained for the steel plate having a yield strength the closest to 140 ksi into Expression (6), an approximate value $K_{140}$ for each test number was obtained. The obtained approximate values $K_{140}$ are given in the column "approximate value" in Table 2. When the approximate value $K_{140}$ was equal to or more than 22 ksi√i, it was determined that the SSC resistance was high.

Test Results

With reference to Table 2, steel with test Nos. 1 to 6 and 10 to 12 each had a chemical composition within the range defined by the present invention and satisfied Expression (1), so that the approximate values $K_{140}$ were each 22 ksi√i or more and the SSC resistance was good.

Steel with test Nos. 7 to 9 containing Cr each had a chemical composition within the range defined by the present invention and satisfied Expressions (1) and (2), and the approximate values $K_{140}$ were each 22 ksi√i or more.

Meanwhile, for steel with test Nos. 13 to 27, the approximate values $K_{140}$ were each less than 22 ksi√i, and the SSC resistance was poor. More specifically, the steel with test Nos. 13 to 23 each had a chemical composition partly outside the range defined by the present invention, so that the SSC resistance was poor. The Mn content of steel with test No. 15 in particular exceeded the upper limit according to the invention, the SSC resistance was poor. The Mo contents of steel with test Nos. 18 and 19 were less than the lower limit according to the invention, and the SSC resistance was poor. The V content of steel with test No. 20 was less than the lower limit according to invention, and therefore the SSC resistance was poor. The V content of steel with test No. 21 exceeded the upper limit according to the invention, and the SSC resistance was poor. The Cr content of steel with test No. 23 exceeded the upper limit according to the invention, and the SSC resistance was poor.

Steel with test Nos. 24 and 25 each had a chemical composition within the range defined by the present invention but did not satisfy Expression (1). Therefore, the SSC resistance was poor. Steel with test Nos. 26 and 27 each had a chemical composition within the range defined by the present invention but did not satisfy Expression (2). Therefore, the SSC resistance was poor.

Although the embodiment of the present invention has been described, the same is by way of illustration and example only and is not to be taken by way of limitation. The invention may be embodied in various modified forms without departing from the spirit and scope of the invention.

INDUSTRIAL APPLICABILITY

Low alloy steel for oil country tubular goods according to the invention can be used as oil country tubular goods, and is particularly applicable as a casing or tubing for use in an oil well or a gas well.

What is claimed is:

1. Low alloy steel for oil country tubular goods having high sulfide stress cracking resistance, comprising, in percentage by mass, 0.20% to 0.35% C, 0.05% to 0.5% Si, 0.05% to 0.6% Mn, at most 0.025% P, at most 0.01% S, 0.005% to 0.100% Al, 0.8% to 3.0% Mo, 0.05% to 0.25% V, 0.0001% to 0.005% B, at most 0.01% N, and at most 0.01% O, the balance comprising Fe and impurities, said low alloy steel satisfying Expression (1):

$$12V+1-Mo \geqq 0 \quad (1)$$

where the symbols of elements represent the contents of the elements in percentage by mass.

2. The low alloy steel for oil country tubular goods according to claim 1, further comprising at most 0.6% Cr and satisfying Expression (2):

$$Mo-(Cr+Mn) \geqq 0 \quad (2)$$

where the symbols of elements represent the contents of the elements in percentage by mass.

3. The low alloy steel for oil country tubular goods according to claim 1, further comprising at least one of at most 0.1% Nb, at most 0.1% Ti and at most 0.1% Zr.

4. The low alloy steel for oil country tubular goods according to claim 1, further comprising at most 0.01% Ca.

5. The low alloy steel for oil country tubular goods according to claim 1, further having at least 861 MPa yield strength.

6. The low alloy steel for oil country tubular goods according to claim 2, further comprising at least one of at most 0.1% Nb, at most 0.1% Ti and at most 0.1% Zr.

7. The low alloy steel for oil country tubular goods according to claim 2, further comprising at most 0.01% Ca.

8. The low alloy steel for oil country tubular goods according to claim 3, further comprising at most 0.01% Ca.

9. The low alloy steel for oil country tubular goods according to claim 2, further having at least 861 MPa yield strength.

10. The low alloy steel for oil country tubular goods according to claim 3, further having at least 861 MPa yield strength.

11. The low alloy steel for oil country tubular goods according to claim 4, further having at least 861 MPa yield strength.

12. The low alloy steel for oil country tubular goods according to claim 6, further comprising at most 0.01% Ca.

13. The low alloy steel for oil country tubular goods according to claim 6, further having at least 861 MPa yield strength.

14. The low alloy steel for oil country tubular goods according to claim 7, further having at least 861 MPa yield strength.

15. The low alloy steel for oil country tubular goods according to claim 8, further having at least 861 MPa yield strength.

16. The low alloy steel for oil country tubular goods according to claim 12, further having at least 861 MPa yield strength.

* * * * *